US005843194A

United States Patent [19]

Spaulding

[11] Patent Number: 5,843,194

[45] Date of Patent: Dec. 1, 1998

[54] CLEAR GEL FORMULATION FOR USE IN TRANSPARENT CANDLES

[75] Inventor: Laura A. Spaulding, Wayne, N.J.

[73] Assignee: The Noville Corporation, South Hackensack, N.J.

[21] Appl. No.: 901,449

[22] Filed: Jul. 28, 1997

[51] Int. Cl.[6] ..... C10L 5/00

[52] U.S. Cl. ..... 44/275; 44/265; 44/459; 431/288

[58] Field of Search ..... 44/275, 265, 459; 431/288

[56] References Cited

U.S. PATENT DOCUMENTS

| | | | |
|---|---|---|---|
| 1,950,814 | 3/1934 | Pungs et al. | 44/278 |
| 2,831,330 | 4/1958 | Walker | 44/275 |
| 3,411,855 | 11/1968 | Olund | 44/275 |
| 3,615,289 | 10/1971 | Felton . | |
| 3,630,697 | 12/1971 | Duling | 44/275 |
| 3,645,705 | 2/1972 | Miller et al. . | |
| 3,741,711 | 6/1973 | Bryant . | |
| 3,819,342 | 6/1974 | Gunderman et al. . | |
| 4,855,098 | 8/1989 | Taylor | 44/275 |
| 5,221,534 | 6/1993 | DesLauriers et al. . | |
| 5,429,816 | 7/1995 | Hofrichter et al. . | |
| 5,522,136 | 6/1996 | Motley | 424/68 |
| 5,578,089 | 11/1996 | Elsamaloty . | |

FOREIGN PATENT DOCUMENTS

WO 88/00603 1/1988 WIPO .

*Primary Examiner*—Margaret Medley
*Attorney, Agent, or Firm*—Kenyon & Kenyon

[57] ABSTRACT

The present invention is directed to transparent candle compositions, and methods of preparation thereof, comprised of a clear gel obtained by combining a liquid base material of a hydrogenated polyolefin, a gelling agent, and, optionally, a gel enhancing agent so as to produce either a pourable or non-pourable gel. As a representative example of the invention, the transparent candle composition is a clear gel obtained from hydrogenated polyisobutene that has a repeating unit having the following chemical structure:

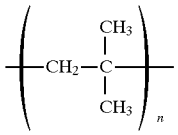

wherein the hydrogenated polyisobutene is comprised of a mixture of higher viscosity component having an average number of repeating units wherein n is about 23 and lower viscosity component having an average number of repeating units wherein n is about 6 to 8, the gelling agent is N-acyl glutamic acid diamide, and additional components may include isostearyl alcohol, dimethyl isosorbide and/or 12-hydroxystearic acid, or derivatives thereof, or additional components may include butyl stearate.

8 Claims, No Drawings

CLEAR GEL FORMULATION FOR USE IN TRANSPARENT CANDLES

FIELD OF INVENTION

The present invention relates to clear gel formulations that are useful as the base material of a transparent candle, to the transparent candles made therefrom, and to methods of making the same.

BACKGROUND OF THE INVENTION

While the burning of a candle might appear to be simple and uninvolved, the process that takes place in the burning of a candle has been described, in fact, as a process that imposes rather stringent requirements upon the candle body material, U.S. Pat. Nos. 5,578,089, 3,819,342, 3,645,705 and 3,615,289. This is illustrated, in particular, with respect to the actual burning of the candle when the heat of the candle's flame melts a small pool of the candle body material around the base of the exposed portion of the wick. This molten material is then drawn up through and along the wick by capillary action to fuel the flame. A candle's melting point is, therefore, important in that the candle material should liquefy at or below temperatures to which the candle's material can be raised by radiant heat from the candle flame. If the candle's melting temperature is too low, the candle will drip or, in an extreme case, the entire candle body will melt, dropping the wick into a pool of molten body material, with the potential that the surface of the pool could ignite. If too high a temperature is required to melt the body material, the flame will be starved because insufficient fuel will be drawn up through the wick, with the result that the flame will be too small to maintain itself. Moreover, when molten, the candle body material preferably has a relatively low viscosity to insure that it will be capable of being drawn up through the wick by capillary action. In addition to meeting the above requirements, it is preferred that the candle body material burn with a flame that is both luminous and smokeless, and that the odors produced by its combustion should not be unpleasant or intrusive.

The desire to make candles that are transparent or clear places still further demands on these already stringent requirements. The terms "clear" and "transparent" are used interchangeably herein and connote a substantial absence of cloudiness or obscurity, so that the body of the candle features an ability to let light pass through in a substantially unobstructed manner, and an ability to have colorant added to the composition without causing cloudiness or reducing the candle's ability to let light pass through in a fairly unobstructed manner. To add yet one more demand on transparent candle compositions, it would also be desirable if the transparent candles could be used as a fragrance carrier composition for dispersing selected fragrances such as insect repellents.

Clear compositions that are typically used as carriers for dispensing fragrances, either from the heated reservoir of a tart candle or from a burning candle, are typically comprised of materials that, while they have a high throwing power for dispensing the desired fragrance, have certain disadvantages. In particular, such compositions are typically comprised of materials that are both volatile and highly flammable, so that the fumes from such compositions can cause the compositions to auto-ignite. Such auto-ignition is of special concern whenever these compositions are used as the base material of a candle. Moreover, though these carrier compositions are specifically intended for use in dispensing fragrances that have a pleasant or particularly desired odor, such as for repelling insects, the compositions may themselves have a strong unpleasant odor. In such cases, the fragrance is required, in part, simply to mask such undesired odors. As a result, such masking may reduce the benefit or require higher levels of the fragrance than might otherwise be desired.

Transparent candle compositions which are comprised of a thermoplastic polyamide resin and a flammable solvent for solubilizing the resin, such as described in U.S. Pat. Nos. 3,615,289 and 3,819,342 are vulnerable to auto-ignition, and tend to sweat and produce black smoke during burning. Sweating is the process whereby oils migrate out of the candle body to the surface, giving it an oily texture, and is most commonly caused by syneresis. Syneresis occurs whenever oil is physically squeezed out from the candle body because of excessive chemical cross linking. Sweating is not only an aesthetic drawback, but can be a performance or safety problem as well. If a candle sweats, the oil on the surface is available to ignite, which can result in an uncontrolled or torch-like situation rather than a candle.

U.S. Pat. No. 5,578,089 describes a heterophase thermally reversible mineral oil gel formed by a system of physically crosslinked block copolymers which purportedly overcome the problem of sweating and syneresis by adjusting the ratio of diblock and triblock polymers so as to ensure that all the oil remains entrained within a system of physically crosslinked copolymers. The thermoplastic rubber type polymers of U.S. Pat. No. 5,578,029 consist of block segments of styrene monomer units and rubber monomer units, wherein each block segment may consist of 100 monomer units or more (col. 7, lines 4–20). While such compositions are alleged to provide an improvement over the prior art transparent candle compositions, styrene/rubber-based candle compositions are susceptible to producing black smoke and unpleasant odors during burning.

It would be desirable to have transparent and odorless base materials that could be used to prepare transparent candle compositions that have an aesthetically attractive appearance and that can burn safely and cleanly. It would also be desirable if fragrances could be readily dissolved in the base material of the transparent candle compositions without causing cloudiness.

The present invention is directed toward transparent candle compositions that provide these advantages while not being handicapped with the above-noted disadvantages.

ADVANTAGES AND SUMMARY OF THE INVENTION

The present invention is directed to clear gel formulations that are useful as the base material for transparent candle compositions that burn safely and cleanly and which may be used for dispensing fragrances.

More specifically, the present invention is directed to clear gel formulations obtained by combining a gelling agent with a liquid base material comprised of a hydrogenated polyolefin.

As a representative embodiment, the present invention is directed to clear gel formulations comprised of hydrogenated polyisobutenes as the predominant component, wherein the polyisobutene may be comprised of two grades of polyisobutene, with the major fraction being of high viscosity and the minor fraction being of low viscosity.

Yet more specifically, the present invention is directed to transparent candle compositions having a gel structure wherein a gelling agent comprised of a derivative of an N-acyl amino acid is used to produce gelling of the transparent candle composition.

The present invention further includes use of a gel-enhancing agent for enhancing the gelling effect of the gelling agent in the presence of the hydrogenated polyolefins.

Yet more specifically, the present invention is directed to combinations of additional materials that can be included in the hydrogenated polyolefins compositions so as to produce candles having the desired combination of aesthetic improvements. Such aesthetic improvements include having transparent candles that burn with a whiter flame, that is, a less yellow, hotter burning flame; a wider pool, which provides greater fragrance throw; less surface tack; greater clarity and less haze or cloudiness; including compositions that are even crystal clear; and less bloom produced by the wick. In particular, the additional materials that may be included in the transparent candle compositions include use of isostearyl alcohol and derivatives thereof, dimethyl isosorbide and derivatives thereof, and/or an alkyl stearate, for example, butyl stearate.

The present invention is also directed toward methods of making transparent candles from the clear gel formulations disclosed herein.

The transparent candles of the present invention are, in particular, characterized by being formed of a clear gel formulation that is capable of burning with a smoke-free flame, and are further characterized by being formed of a base material that does not auto-ignite over the top surface of the candle whenever the candle is burning. The transparent candle compositions are further characterized by being capable of producing a high throwing power for fragrances which, if present, may be dissolved in the clear base material without causing cloudiness.

Further objectives and advantages of the subject invention will be apparent to those skilled in the art from the detailed description of the disclosed invention.

DETAILED DESCRIPTION OF THE PREFERRED EMBODIMENTS

The subject invention will now be described in detail for specific preferred embodiments of the invention, it being understood that these embodiments are intended only as illustrative examples and the invention is not to be limited thereto.

The transparent candle compositions of the present invention are comprised of a clear and odorless base material which may be formulated to be useful for different types of applications. In one set of transparent candle applications, a liquid base material may be formulated with gelling agent present in an amount sufficient to produce a semi-solid gel that is not pourable at ambient temperature. The gelling agent may be present either as a single gelling agent or as a combination of one or more gelling agents, with the additional gelling agent being referred to herein as a secondary gelling agent or gel-enhancing agent. In those cases whenever the gelling results in a semi-solid gel, the formulated base material may be added at an elevated temperature, when it is still pourable, to a suitable vessel for containing the semi-solid gel. At an appropriate stage of the cooling cycle, a wick may be embedded in the gel, with a portion of the wick extending out of the gel.

In another set of applications, the transparent liquid base material may be combined with a gelling agent, and, also optionally, a secondary gelling agent or a gel-enhancing agent, to form a gel that is pourable at ambient temperature and that is also useful as a transparent candle composition. For this type of application, the transparent candle is comprised of a suitable transparent vessel for containing the gel, in which a wick is already included as part of the vessel structure. In this case, the candle structure may be used many times by re-filling the vessel with a fresh supply of the pourable gel after each usage.

In a representative embodiment of the present invention, the liquid base material is comprised of a hydrocarbon composition that is a clear, colorless and odorless liquid at ambient temperature. In particular, the base material is comprised predominantly of a hydrogenated polyolefin. The degree of hydrogenation is preferably such as to produce a substantially fully saturated polyolefin. Though experiments have not been conducted to quantitatively determine the degree of hydrogenation that provides the most desired results for the present invention, it is believed that the polyolefin needs to have at least 90% of the free olefinic groups of the polyolefin saturated by hydrogenation, even though it is also believed that only about 10% hydrogenation of the free olefinic group of the polyolefin may be acceptable under certain circumstances.

In a preferred embodiment of the subject invention, the liquid base material is comprised of hydrogenated polyisobutene, which is commercially available under the name Panalan™. The repeating unit of hydrogenated polyisobutene is shown by the following chemical structure:

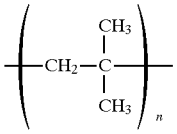

Panalane™ is commercially available from Lipo Chemical of Paterson, N.J. or Indopol™ from Amoco Chemical Company, Chicago, Ill. The Panalane™ from Lipo Chemical is available in two grades, as a higher viscosity component, Grade H-300E, where the average number of repeating units n is about 23, or as a lower viscosity component, Grade L-14E, where the average number of repeating units n is about 6 to 8.

In a preferred embodiment, the liquid base material is comprised of the higher viscosity component as the major proportion and the lower viscosity component as the minor proportion. The ratio of the higher viscosity fraction to the lower viscosity fraction may be determined to be that which provides the desired balance between the many stringent requirements which are imposed on the physical characteristics of transparent candles. Thus, while there may be preferred ranges for the ratio of higher viscosity component to the lower viscosity component, dependent on whether a pourable gel or a semi-solid gel is prepared, the liquid base material may be comprised substantially entirely either of the higher viscosity component or of the lower viscosity component. In particular, the range for the higher viscosity component may be from 0 wt. % to about 99.99 wt. % and the lower viscosity component may be from about 99.99 wt. % to 0 wt. %, respectively. For a pourable gel, the higher viscosity component is, most preferably, about 75 wt. % and the lower viscosity component is, most preferably, about 22 wt. %. For a non-pourable, semi-solid gel, the higher viscosity component is from about 75 to about 85 wt. % and the lower viscosity component is, most preferably, about 5 to about 15 wt. %. For a non-pourable, semi-solid gel, the higher viscosity component is, most preferably, about 85 wt. % and the lower viscosity component is, most preferably, about 11–12 wt. %.

A preferred liquid base material of the present invention, hydrogenated polyisobutene, has the advantage of being readily available in commercial quantities as an ingredient that is listed in the Cosmetic Toiletry and Fragrance Associate Ingredient Dictionary, having a CAS number of 68937-10-0. The odorless, low volatility base materials of the present invention are, thus, recognized as toxicologically safe for use in the cosmetic arts. Furthermore, the base materials of the present invention have no tendency to auto-ignite. Such auto-ignition, which is caused by excessive fumes emanating from the surface, may occur with certain prior art transparent candle compositions, such as those which use kerosene, lamp oil or a mineral oil/styrene/rubber copolymer mix.

Though the liquid base materials of the present invention are specifically disclosed in the preferred embodiments as being comprised of high and low viscosity fractions of hydrogenated polyisobutenes, which are recognized as toxicologically safe and readily available as commercial materials in the cosmetic arts, it is to be understood that the hydrogenated polyisobutenes are representative of a much broader class of compounds which fall fully within the scope and spirit of the present invention. In particular, the present invention is directed to transparent candle compositions prepared from liquid base materials that may be comprised of hydrogenated polyolefins generally. Preferably, the hydrogenated polyolefins are hydrogenated polyalkenes, and still more preferably, the hydrogenated polyalkenes are hydrogenated polyisoalkenes.

Preferably, the hydrogenated polyolefins are hydrogenated polyalkenes which are substantially free of phenyl groups in the chemical structure, especially, polyalkenes in which there are no phenyl groups in the repeating unit. Such phenyl groups are believed to be capable of producing odors as well as in causing the flame to burn less cleanly.

Still more preferably, the hydrogenated polyalkenes are hydrogenated polyisoalkenes. The term "polyisoalkenes" refers to polyalkenes which include a skeletal isocarbon in the repeating unit of the polyalkene. A skeletal "isocarbon" is a skeletal carbon atom that is chemically bound to three carbon atoms in the repeating unit. Preferably, substantially all the olefinic bonds of the polyolefin are hydrogenated so as to produce a fully saturated polyolefin. Fully saturated is herein understood to mean at least 90% of the free olefinic groups of the polyolefin are saturated by hydrogenation.

For the pourable or non-pourable gels for use as the transparent candle compositions, the liquid base material further includes a gelling agent that is present in an amount so as to produce the pourable gel or non-pourable gel, respectively. The term "gelling agent" as used herein may refer to a single gelling agent or a mixture of a primary gelling agent and a secondary gelling agent. The primary gelling agent is selected from the group consisting of an n-acyl amino acid or a derivative thereof. While any of a large number of gelling agents may be used, it has been found that a derivative of an N-acyl amino acid, such as disclosed in U.S. Pat. No. 5,429,816, may be used so as to produce the pourable or non-pourable gels for candle compositions that satisfy the combination of characteristics sought for the transparent candles of the present invention. The n-acyl amino acid derivatives include n-acyl amino acid amides and n-acyl amino acid esters prepared from glutamic acid, lysine, glutamine, aspartic acid and mixtures thereof. Particularly preferred are n-acyl glutamine acid amides and n-acyl glutamic acid esters corresponding to the following formula:

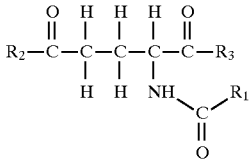

wherein $R_1$ is an alkyl, aryl, arylalkyl radical (branched, linear or cyclic), having from about 1 to about 26 carbon atoms; preferably, from about 6 to about 22 carbon atoms; more preferably, from about 12 to about 18 carbon atoms. $R_2$ and $R_3$ are the same or different, preferably the same, alkyl, aryl, arylakyl ester radical or amide radical, in which the alkyl, aryl, arylalkyl moiety (branched, linear or cyclic) has from about 1 to about 26 carbon atoms; preferably, from about 2 to about 20 carbon atoms.

Preferably, the n-acyl amino acid derivatives are selected from the group consisting of N-lauroyl-glutamic acid diethyl amide, N-lauroyl-glutamic acid dibutyl amide, N-lauroyl-glutamic acid dihexyl amide, N-lauroyl-glutamic acid dioctyl amide, N-lauroyl-glutamic acid didecyl amide, N-lauroyl-glutamic acid didodecyl amide, N-lauroyl-glutamic acid ditetradecyl amide, N-lauroyl-glutamic acid dihexadecyl amide, N-lauroyl-glutamic acid distearyl amide, N-stearoyl-glutamic acid dibutyl amide, N-stearoyl-glutamic acid dihexyl amide, N-stearoyl-glutamic acid diheptyl amide, N-stearoyl-glutamic acid dioctyl amide, N-stearoyl-glutamic acid didecyl amide, N-stearoyl-glutamic acid didodecyl amide, N-stearoyl-glutamic acid ditetradecyl amide, N-stearoyl-glutamic acid dihexadecyl amide, N-stearoyl-glutamic acid distearyl amide and mixtures thereof; more preferred, is n-lauroyl-glutamic acid dibutyl amide, n-stearyl-glutamic acid dihexyl amide, and mixtures thereof.

As used herein, the term "liquid" refers to materials which are liquids at ambient conditions and the term "liquid base material" includes all liquids within the composition. It is important that the liquid base material be of a type and used at a level sufficient to solubilize the gelling agent when heated. The liquid base material must be compatible with the gelling agent so that the mixture of the two remains homogeneous and does not phase separate during manufacturing and so that the finished product remains homogeneous and does not phase separate at ambient conditions over the normal shelf-life which may be upwards of one year, or even substantially more. Furthermore, the liquid base materials are typically selected to provide aesthetic benefits, such as transparency and low tack.

The liquid base material of the present invention is preferably a non-volatile, non-polar, oil. The term "non-volatile" as used herein refers to materials which exhibit a vapor pressure of no more than about 0.2 mm Hg at 25° C. at one atmosphere and/or to materials which have a boiling point at one atmosphere of at least about 300° C.

In particular, it has been found that N-acyl glutamic acid diamide provides a particularly advantageous combination of performance characteristics. The gelling agent is typically present in an amount corresponding to about 0.025 to about 1.0 wt. % of the total composition. In the preferred embodiments of the pourable gel compositions, the gelling agent is N-acyl glutamic acid diamide (hereinafter the "GP-1 gelling agent"), which is commercially available as Ajinomoto GP-1, from Ajinomoto Co., Inc. of Tokyo, Japan, and comprises about 0.05–0.1 wt. % of the total clear gel formulation. For the most preferred embodiments of the non-pourable gel compositions, N-acyl glutamic acid diamide comprises about 0.4–0.6 wt. % of total clear gel formulation.

The gelling agent also has the effect of helping to reduce the evaporation rate of the volatile components in the composition to which it is added, as well as in helping to promote formation of the liquid pool around the wick.

The amino-acid-based gelling agent is one that is typically used for gelling an oil, wherein the addition of only a relatively small amount of the gelling agent is sufficient to cause almost all oils, ranging from petroleum to vegetable oils, to form a gel. As shown by the above-noted structure, the amino-acid-based gelling agent has the N-acyl amino acid as a basic skeleton. Thus, since the gelling agent is a condensate of a naturally-occurring amino acid and a fatty acid, the product is a very safe agent for gelling oils that are to be used in candle compositions that may be used to dispense fragrances.

The additional materials that may be included to improve the overall combination of aesthetic characteristics are those materials which can help to produce a larger pool and a whiter, hotter flame, as well as to produce crystal clear gel formulations that may even be characterized as having a sparkling clear appearance. Such materials may be referred to herein as flame-enhancing agents and/or as clarity-enhancing agents. However, it is to be noted that while any one of the specific gel formulation components may be referred to as enhancing a particularly preferred property, such components may influence several of the desired properties simultaneously. For example, it was discovered that isostearyl alcohol could be added as a flame-enhancing agent, so as to produce whiter, hotter flames, it also provided improved gel clarity by reducing the haze that may sometimes be produced in the gel.

A particular feature of the present invention is that a flame-enhancing material such as isostearyl alcohol could be added, within a prescribed range, without producing an unacceptably increased risk of auto-ignition of the entire candle surface. This benefit results from the fact that the preferred base materials of the present invention, hydrogenated polyisobutene, are not themselves susceptible to the auto-ignition problems associated with the base materials of prior art transparent candle compositions. The flame-enhancing agent is preferably present in the range from about 3 wt. % up to about 8 wt. % of the total clear gel formulation. At levels below about 3 wt. %, minimal improvement in the pool size or flame was observable and at a level of about 10 wt. %, auto-ignition tended to occur. Compositions including isostearyl alcohol were observed to produce clear gel formulations of exceptional clarity. Isostearyl alcohol is readily available commercially.

An additional component that is also preferable included as a flame-enhancing agent is dimethyl isosorbide. Thus, while it was discovered that compositions including isostearyl alcohol could produce gel formulations of exceptional clarity and that provided a white flame, it was also discovered that compositions that included both isostearyl alcohol and dimethyl isosorbide produced gel formulations having an even greater, sparkling clarity, as well as even whiter flames. The preferred embodiments of the present invention include from 0 wt. % to about 6 wt. % of the dimethyl isosorbide.

Table 1 shows the results of varying the dimethyl isosorbide, the isostearyl alcohol and the GP-1 gelling agent in certain candle compositions. These clear gel formulations further included 80.0 wt. % Panalane™ H300E, 7.1 wt. % Panalane™ L14E, 2 wt. % Sweet Peach and 0.4 wt. % red and yellow dyes, 0.2 wt. % each, of the total clear gel formulation.

Table 1. Determination of effect of the dimethyl isosorbide, isostearyl alcohol and GP-1 gelling agent concentration on candle clarity and on the candle burning characteristics. Concentration is given in wt. % of the total clear gel formulation.

| | Sample | | | | | | | | |
|---|---|---|---|---|---|---|---|---|---|
| | A | B | C | D | E | F | G | H | I |
| di-methyl iso-sorbide | 5.0 | 5.0 | — | 5.0 | 5.0 | 5.0 | 6.0 | 7.0 | 8.0 |
| iso-stearyl alcohol | 5.0 | — | 5.0 | 5.0 | 5.0 | 5.0 | 5.0 | 5.0 | 5.0 |
| GP-1 gelling agent | 0.5 | 0.5 | 0.5 | 0.6 | 0.7 | 0.8 | 0.5 | 0.5 | 0.5 |
| candle clarity | clear | cloudy | clear | clear | clear | clear | clear | cloudy | cloudy |
| candle burning | OK | — | OK | OK | OK | smoke | OK | — | — |

A comparison of the results for candle compositions A and B shows that the isostearyl alcohol is needed in combination with the dimethyl isosorbide so as to solubilize the latter. It was further observed that in comparison with candle composition C, candle composition A produced a whiter flame, a wider pool and burned longer. The presence of the dimethyl isosorbide allowed higher levels of the GP-1 gelling agent, 0.6, 0.7 and 0.8 wt. %, to go into solution and remain crystal clear on cool down as compared with using isostearyl alcohol alone. For candle composition E, the pool size was smaller and the burn rate was noticeably slower than for candle compositions A and D.

The additional materials that may be included to improve aesthetic characteristics also include those materials which can help to reduce surface tack. Since the present invention relates to selecting materials as non-pourable gels, a careful balance needs to be established between gels that are too hard or so firm as to result in reduced pool size and, thus, reduce fragrance throwing power, and gels that are too soft such that the gels have an undesirable surface tack. It has been discovered that certain materials may be included as a surface-tack-reducing agent, which also serve to provide whiter, hotter flames during burning of the candle. Such a surface-tack-reducing agent may be 12-hydroxystearic acid or a derivative thereof, in particular, a derivative selected from the group consisting of esters of 12-hydroxystearic acid, amides of 12-hydroxystearic acid and derivatives or mixtures thereof. In addition, these materials also function as gelling or gel enhancing agents, such as disclosed in U.S. Pat. No. 5,429,816, which was directed to solid, opaque antiperspirant gel stick formulations.

The 12-hydroxystearic acid, amides of 12-hydroxystearic acid and derivatives or mixtures thereof correspond compounds having the following formula:

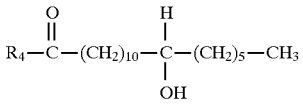

wherein $R_4$ is $OR_5$ or $NR_2R_6$, and $R_5$ and $R_6$ are hydrogen, or an alkyl, aryl, or arylalkyl radical, which is branched, linear or cyclic and has from about 1 to about 22 carbon atoms; preferably, from about 1 to about 18 carbon atoms. $R_5$ and $R_6$ may be either the same or different; however, at least one is preferably a hydrogen atom.

The surface-tack-reducing agent, which also functions in part as a gelling agent, is preferably selected from the group consisting of 12-hydroxystearic acid, 12-hydroxystearic acid methyl ester, 12-hydroxystearic acid ethyl ester, 12-hydroxystearic acid stearyl ester, 12-hydroxystearic acid benzyl ester, 12-hydroxystearic acid amide, isopropyl amide of 12-hydroxystearic acid, butyl amide of 12-hydroxystearic acid, benzyl amide of 12-hydroxystearic acid, phenyl amide of 12-hydroxystearic acid, t-butyl amide of 12-hydroxystearic acid, cyclohexyl amide of 12-hydroxystearic acid, 1-adamantyl amide of 12-hydroxystearic acid, 2-adamantyl amide of 12-hydroxystearic acid, diisopropyl amide of 12-hydroxystearic acid, and mixtures thereof, even more preferably, 12-hydroxystearic acid, isopropyl amide of 12-hydroxystearic acid, and mixtures thereof.

Particularly preferred surface-tack-reducing agents include CENWAX™ A, which is 12-hydroxystearic acid, or CENWAX™ ME, which is methyl-12-hydroxystearate, and which are available from Union Camp, Jacksonville, Fla. The clear gel formulations may include 0 wt. % to about 4 wt. % of the surface-tack-reducing agent. More preferably, the clear gel formulations include about 0.8 to about 1.5 wt. % of the surface-tack-reducing agent, if present.

Table 2 shows the results obtained as a function of the particular combination of additional components that were present in the formulation.

TABLE 2

Comparison of candle clarity as a function of the particular combination of dimethyl isosorbide, isostearyl alcohol and CENWAX ™ A that was present, in wt. % of the total gel formulation.

| | Sample No. | | | | |
|---|---|---|---|---|---|
| | J | K | L | M | N |
| Dimethyl isosorbide | 5.0 | — | 5.0 | 5.0 | — |
| Isostearyl alcohol | 5.0 | 5.0 | — | 5.0 | — |
| CENWAX ™ A | 1.2 clear | 1.2 clear | 1.2 opaque | — clear | 1.2 cloudy |

The formulations of Table 2 also included 78 wt. % H300 E, q.s. wt. % L14E, 2.0 wt. % fragrance, 0.4 wt. % dye, 0.5 wt. % GP-1 gelling agent. Sample formulation J had a firm, non-tacky, surface and was quick gelling, whereas sample formulation K, which also had a firm, non-tacky surface was slower gelling. The latter formulation has the advantage of permitting fragrance to be added at a lower temperature, so as to reduce evaporative losses of the fragrance during preparation. Sample formulation M produced a tacky surface.

The results of Table 2 show that the dimethyl isorsorbide plays a role in gellation and also that the isostearyl alcohol was needed to solubilize the CENWAX™ A.

TABLE 3

Comparison of candle clarity for compositions with and without the GP-1 gelling agent in combination with CENWAX ™ A.

| | Sample No. | |
|---|---|---|
| | O | P |
| Dimethyl isosorbide | — | 5.0 |
| Isostearyl alcohol | 5.0 | 5.0 |
| CENWAX ™ A | 2.0 | 2.0 |
| GP-1 gelling agent | — | — |

Both formulations O and P hazed over, thus showing that the GP-1 gelling agent is needed to solubilize the CENWAX™ A.

As an additional embodiment of the present invention, it has been found that adding a gel enhancing agent, such as an alkyl stearate, to the base material can enhance the gelling effect of the GP-1 gelling agent in the hydrogenated polyisobutene materials, even though the alkyl stearate by itself may not cause gelling of the base material. In particular, using butyl stearate, it has been found that a smaller amount of the GP-1 gelling agent is needed to achieve the desired flow consistency and to produce suitable pool formation.

While not intending to be limited by the theory of how the present invention works, it is believed that formation of a liquid pool that functions as a "well" around the wick is a necessity during candle burning. The pool helps reduce heat transfer to the container wall as well as allow the melted surface material to easily flow from the outer periphery toward and up the wick. The presence of the pool is believed to be particularly beneficial for enhancing the throwing power for dispersing a fragrance, if present. Furthermore, the pool is believed to help reduce carbon build-up on the wick, therefore, reducing blooming and yielding good combustion, that is, substantially complete combustion that produces no black carbon soot.

This theory is supported by the combination of observations that, if the polyisobutene materials are used alone without a gelling agent, they can also burn with a wick but, there is no pool formation, the walls of the glass container become extremely hot, carbon builds up on the wick and blooms form. These observations support the conclusion that a careful and delicate balancing of the overall heat transport processes is needed so as to achieve the desired safe, clean burning of the clear gel-based candle composition. This includes control of the phase transition temperature from gel to liquid, such that only a limited portion of the surface material liquefies to form the pool, rather than, as for prior art materials, to have complete liquefication of the entire gel occur. The present invention is directed toward methods and materials for which such results can be achieved so as to meet the stringent combination of performance requirements as described herein.

The formulated base materials of the present invention, which need a wick to burn, have the advantage, as compared with prior art transparent candle compositions, that the base materials, which are preferably comprised of hydrogenated polyisobutene, have no tendency to auto-ignite. Such auto-ignition, which is caused by excessive fumes emanating from the surface, occurs with prior art transparent candle compositions which use kerosene, lamp oil or the mineral oil/styrene/rubber copolymer mix, such as described in U.S. Pat. No. 3,819,342. In addition, the clear candles made from the VERSAMID™ polymer of U.S. Pat. No. 3,819,342 tend to require a large proportion of alcohol, even up to about 30 wt. %, and other flammable materials to burn. Candles made from such materials produce a flame which occasionally puts out black smoke. Solid opaque candles, such as those made of paraffin, tend to emit black smoke in the presence of a draft. The formulated base materials of the present invention have been found not to produce black smoke in the presence of a draft.

A suitable transparent container is typically glass or plastic and may have substantially any shape that may be desired for containing a transparent candle. The container may be of any desired height depending on the total burning time or life that is desired for the candle. The diameter of the container is preferably such as to permit the candle to burn in a manner that allows the entire surface area of the gel to be uniformly consumed from top to bottom during the burning lifetime of the candle, in particular, without causing a tunnel to be formed along the core axis of the container. Thus, in the preferred embodiments of the present invention, the upper limit of the diameter is determined to be that which permits adequate heat to be transferred to the outer periphery of the container so as to cause gel at the surface to melt and flow toward the center axis of the container where a liquid pool is consumed by the burning wick. The minimum diameter of the container is preferably such as to avoid having the liquid pool extend to the vessel wall and, thus, to permit the container to be conveniently handled without it becoming too hot to be touched by a bare hand.

The choice of wicking material is also important in making an aesthetically acceptable transparent candle. Wicks containing a paper core have been observed to provide the most desired combination of burn characteristics, especially with respect to attributes such as smoke, bloom, fragrance throw and burn rate. Wicks are commercially available from Atkins-Pearce of Covington, Ky.

The transparent candle compositions of the present invention may also contain a fragrance, for example, Citronella, AN114351 Sweet Peach, AN114349 Mountain Berry, AN114350 Country Garden, AN114462 Lavender Meadows, AN114463 Strawberries 'N Cream and AN114215 Vanilla from Noville Corp., South Hackensack, N.J. Such fragrances are typically added in the range from about 1 wt. % to about 5 wt. %, with the level being selected so as to achieve the desired throwing power.

Since the formulated base materials are typically comprised of colorless materials, the additional materials that may also be added include a coloring agent for producing the desired color appearance. Preferably the dye is a liquid dye since it has been found that powdered dyes tend to break the gel structure.

The burn rates of the transparent candle compositions of the present invention are typically in the range from about 1.4 to about 2 gms/hour as compared with burn rates of 4 gms/hr if the prior art solid opaque paraffin candles are used. Slower burning candles are generally preferred, provided that they produce the desired fragrance throw. Thus, for the substantially slower burning compositions of the present invention, the fragrance throw was of an acceptably high strength for formulated base material compositions comprised of about 0.05 wt. % of the gelling agent for the pourable composition or about 0.5 wt. % of the gelling agent for the non-pourable composition, together with about 3 wt. % of alkyl stearate and about 1–5 wt. % fragrance.

The subject invention as disclosed herein may be used in conjunction with the co-pending application entitled "Fragrance-Carrier Compositions For Use In Tart Candles", Attorney Docket No. 10209/3, which is filed on the same date as the present application, the co-pending application being incorporated herein by reference in its entirety.

This invention will now be described in detail with respect to showing how certain specific representative embodiments thereof will be made, the materials, apparatus and process steps being understood as examples that are intended to be illustrative only. In particular, the invention is not intended to be limited to the methods, materials, conditions, process parameters, apparatus and the like specifically recited herein.

EXAMPLES OF THE INVENTION

The transparent candles of the present invention may be prepared by first adding the hydrogened polyolefin, which may have higher and lower viscosity components; the gelling agent or gelling agents; the flame enhancing agent or agents; the surface-tack-reducing agent; the dye or dyes; and the gel enhancing agent, if present; to a mixing vessel. The materials are heated with agitation, if desired, to an appropriate temperature, e.g., from 135°–142° C., and stirred until clear. This may typically occur in a few minutes. The composition is then removed from the heat, agitation may be reduced and the composition is allowed to cool to the desired temperature for addition of the fragrance, for example, about 105° to about 110° C., although slightly higher or lower temperatures may also be used dependent on the gelling point of the cooling liquid. The coloring agent may also be added at this point.

EXAMPLE 1

Using the above-noted procedure, the following composition was prepared:

85.0 wt. % Panalane™ H300E 6.7 wt. % Panalane™ L14E 5.5 wt. % Isostearyl alcohol 0.4 wt. % GP-1 gelling agent 2.0 wt. % Fragrance 0.4 wt. % Dye This gel formulation was used to make candles having an acceptable combination of performance characteristics, though this formulation did exhibit surface tack.

EXAMPLE 2

Using the above-noted procedure, the following composition was prepared:

80.0 wt. % Panalane™ H300E 7.1 wt. % Panalane™ L14E 5.0 wt. % Isostearyl alcohol 5.0 wt. % Dimethyl isosorbide 0.5 wt. % GP-1 gelling agent 2.0 wt. % Fragrance 0.4 wt. % Dye This gel formulation was also used to make candles having another acceptable combination of performance characteristics, though this formulation also exhibited surface tack.

EXAMPLE 3

Using the above-noted procedure, non-pourable gel formulation were prepared using the following formulation:

78.0 wt. % Panalane™ H300E 7.1 wt. % Panalane™ L14E 5.0 wt. % Dimethyl isosorbide 5.0 wt. % Isostearyl alcohol 0.5 wt. % GP-1 gelling agent 2.0 wt. % CENWAX™ A 2.0 wt. % Fragrance 0.4 wt. % Dye wherein the fragrance was Mountain Berry, Sweet Peach, Vanilla or Country Garden, and a 36-24-24P wick from Atkins-Pearce was used. This candle composition was observed to have the CENWAX™ A surface-tack-reducing agent at too high a level to produce the desired combination of aesthetic characteristics.

EXAMPLE 4

Using the above-noted procedure, the following composition was prepared:

78.0 wt. % Panalane™ H300E 7.9 wt. % Panalane™ L14E 5.0 wt. % Dimethyl isosorbide 5.0 wt. % Isostearyl alcohol 0.5 wt. % GP-1 gelling agent 1.2 wt. % CENWAX™ A 2.0 wt. % Fragrance 0.4 wt. % Dye

EXAMPLE 5

Using the above-noted procedure, the following composition was prepared:

78.0 wt. % Panalane™ H300E 12.9 wt. % Panalane™ L14E 5.0 wt. % Isostearyl alcohol 0.5 wt. % GP-1 gelling agent 1.2 wt. % CENWAX™ A 2.0 wt. % Fragrance 0.4 wt. % Dye The candles of Examples 4 and 5 were not as hard as Example 3, but they were quite clear, had a good flame, and had a desired reduction in surface tack. The candles of Example 5 were slower gelling, thus permitting addition of the fragrance at a slightly lower temperature, which produced less loss of the fragrance by evaporation during preparation.

EXAMPLE 6

Using the above-noted procedure, the following composition was prepared:

78.0 wt. % Panalane™ H300E 13.1 wt. % Panalane™ L14E 5.0 wt. % Isostearyl alcohol 0.5 wt. % GP-1 gelling agent 1.0 wt. % CENWAX™ A 2.0 wt. % Fragrance 0.4 wt. % Dye This candle composition had a crystal clear appearance.

EXAMPLE 7

Also using the above-noted procedure, an example of a non-pourable, semi-solid gel formulation for use as a transparent candle composition was prepared from:

85.00 wt. % Panalane™ H300E 11.50 wt. % Panalane™ L14E 3.00 wt. % Butyl Stearate 0.50 wt. % GP-1 gelling agent Addition of a fragrance to this formulation is also optional but, if present, may be from about 1 wt. % up to about 5 wt. %.

EXAMPLE 8

Also using the above-noted procedure, a pourable gel for a transparent candle was prepared, which did not include any fragrance, as shown by the base formulation:

75.00 wt. % Panalane™ H300E 21.95 wt. % Panalane™ L14E 3.00 wt. % Butyl Stearate 0.05 wt. % GP-1 gelling agent Additional formulations were prepared with 3 different fragrances at 3 wt. % and 5 wt. % concentration levels as shown below:

75.00 wt. % Panalane™ H300E 18.90 wt. % Panalane™ L14E 3.00 wt. % Butyl Stearate 0.10 wt. % GP-1 gelling agent 3.00 wt. % Fragrance The fragrance types included:

Sweet Peach

Mountain Berry

Country Garden

The burn rates for these formulations were as follows:

| Fragrance | 32-24P Wick | 36-24P Wick |
|---|---|---|
| Sweet Peach | 1.6 grams/hour | 1.8 grams/hour |
| Mountain Berry | 1.5 grams/hour | 1.6 grams/hour |
| Country Garden | 1.6 grams/hour | 1.7 grams/hour |

Formulations were also prepared using 5 wt. % of the same fragrance types, as shown below:

75.00 wt. % Panalane™ H300E 16.90 wt. % Panalane™ L14E 3.00 wt. % Butyl Stearate 0.10 wt. % GP-1 gelling agent 5.00 wt. % Fragrance The burn rates for these formulations were as follows:

| Fragrance | 32-24P Wick | 36-24P Wick |
|---|---|---|
| Sweet Peach | 1.7 grams/hour | 1.9 grams/hour |
| Mountain Berry | 1.6 grams/hour | 1.7 grams/hour |
| Country Garden | 1.8 grams/hour | 2.0 grams/hour |
| Control | 1.4 grams/hour | 1.8 grams/hour |

These results showed substantially stable burn rates independent of fragrance, fragrance concentration over the range from 3–5 wt. %, and gelling agent concentration over the range from 0.05–0.10 wt. %.

What is claimed is:

1. A transparent candle composition comprising a clear gel formulation prepared from a liquid base material comprised of hydrogenated polyisobutene that has a repeating unit having the following chemical structure:

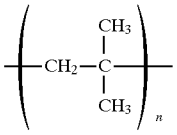

and N-acyl glutamic acid diamide, the hydrogenated polyisobutene being comprised of a higher viscosity component having an average number of repeating units of about 23 and a lower viscosity component having an average number of repeating units of about 6 to 8.

2. The transparent candle composition of claim 1 wherein the clear gel formulation is prepared from a liquid base material further comprised of isostearyl alcohol.

3. The transparent candle composition of claim 1 wherein the clear gel formulation is prepared from a liquid base material further comprised of dimethyl isosorbide or a derivative thereof.

4. The transparent candle composition of claim 1 wherein the clear gel formulation is prepared from a liquid base material further comprised of 12-hydroxystearic acid or a derivative thereof.

5. The transparent candle composition of claim 1 wherein the clear gel formulation is prepared from a liquid base material further comprised of butyl stearate.

6. The transparent candle composition of claim 1 wherein the transparent candle composition is pourable wherein the higher viscosity component comprises about 85 wt. % of the total transparent candle composition, the lower viscosity component comprises about 11.5 wt. % of the total transparent candle composition, butyl stearate comprises about 3 wt. % of the total transparent candle composition, and N-acyl glutamic acid diamide comprises about 0.5 wt. % of the total transparent candle composition.

7. The transparent candle composition of claim 1 wherein the transparent candle composition is pourable wherein the higher viscosity component comprises about 75 wt. % of the total transparent candle composition, the lower viscosity component comprises about 21.95 wt. % of the total transparent candle composition, butyl stearate comprises about 3 wt. % of the total transparent candle composition, and N-acyl glutamic acid diamide comprises about 0.05 wt. % of the total transparent candle composition.

8. A method of making a transparent candle comprising:

adding a liquid base material and a gelling agent to a mixing vessel, wherein the liquid base material is comprised of a hydrogenated polyolefin;

heating the liquid base material to a temperature sufficient to solubilize the gelling agent;

cooling the liquid base material solubilized with the gelling agent so as to form a clear gel formulation;

pouring the clear gel formulation into a vessel; and embedding a wick in the clear gel formulation, with a portion of the wick extending out of the top surface of the clear gel formulation, so as to make a transparent candle.

* * * * *

UNITED STATES PATENT AND TRADEMARK OFFICE

CERTIFICATE OF CORRECTION

PATENT No. : 5,843,194

DATED : December 1, 1998

INVENTOR(S): Laura A. SPAULDING

It is certified that error appears in the above-identified patent and that said Letters Patent is hereby corrected as shown below:

Column 15, line 14, after "repeating units" delete "of" and insert --wherein n is -- therefor;

Column 15, line 16, after "units" delete "of" and insert --wherein n is -- therefor; and Column 15, line 16, after "8", insert -- , and having a wick embedded in the clear gel formulation, with a portion of the wick extending out of the top surface of the clear gel formulation -- .

Signed and Sealed this

Eighth Day of May, 2001

*Attest:*

Nicholas P. Godici

NICHOLAS P. GODICI

*Attesting Officer*

*Acting Director of the United States Patent and Trademark Office*